United States Patent [19]

Lueptow

[11] Patent Number: 4,480,751

[45] Date of Patent: Nov. 6, 1984

[54] APPARATUS FOR COLLECTING, STORING AND DISPENSING FROZEN BLOOD PLASMA

[75] Inventor: Richard M. Lueptow, Allston, Mass.

[73] Assignee: Haemonetics Corporation, Braintree, Mass.

[21] Appl. No.: 567,137

[22] Filed: Dec. 30, 1983

Related U.S. Application Data

[63] Continuation of Ser. No. 305,490, Sep. 25, 1981, abandoned.

[51] Int. Cl.[3] ..... B65D 33/00

[52] U.S. Cl. ..... 206/628; 206/604; 206/627; 206/632; 383/94; 383/107

[58] Field of Search ..... 206/604, 627, 628, 629, 206/632, 620; 229/48 T, 48 SB, 22, 87 F; 604/408; 383/94, 107

[56] References Cited

U.S. PATENT DOCUMENTS

| | | | |
|---|---|---|---|
| D. 199,935 | 12/1964 | Dykes et al. | D58/2 |
| 2,227,236 | 12/1940 | Vogt | 229/48 T |
| 2,341,056 | 2/1944 | Moore | 229/1.5 |
| 2,741,079 | 4/1956 | Rausing | 53/180 |
| 3,032,251 | 5/1962 | Jarund | 229/22 |
| 3,034,695 | 5/1962 | Berghgracht | 229/22 |
| 3,038,649 | 6/1962 | Rausing | 229/17 |
| 3,051,368 | 8/1962 | Schneider et al. | 229/48 T |
| 3,092,248 | 6/1963 | Lane et al. | 206/46 |
| 3,259,235 | 7/1966 | Sowle | 206/628 |
| 3,260,358 | 7/1966 | Gottily et al. | 206/632 |
| 3,347,363 | 10/1967 | Dykes et al. | 206/65 |
| 3,367,551 | 2/1968 | Wheeler | 229/17 |
| 3,379,360 | 4/1968 | Crossley | 229/22 |
| 3,387,701 | 6/1968 | Schneider et al. | 206/46 |
| 3,419,137 | 12/1968 | Walck | 206/632 |
| 3,516,537 | 6/1970 | Oreyfus et al. | 206/632 |
| 3,542,190 | 11/1970 | Keller | 206/46 |
| 3,604,616 | 9/1971 | Greif | 206/632 |
| 3,615,711 | 10/1971 | Markus et al. | 206/628 |
| 3,720,305 | 3/1973 | Barton | 206/47 |
| 3,734,388 | 5/1973 | Hopkins | 229/7 |
| 3,750,937 | 8/1973 | Goodwin | 206/604 |
| 3,791,570 | 2/1974 | Hopkins | 229/7 |
| 4,145,449 | 3/1979 | Nelham | 206/632 |
| 4,253,458 | 3/1981 | Bacehowski et al. | 128/272 |

FOREIGN PATENT DOCUMENTS

| | | | |
|---|---|---|---|
| 1270072 | 7/1961 | France | 229/22 |

*Primary Examiner*—Stephen P. Garbe

*Attorney, Agent, or Firm*—Hamilton, Brook, Smith and Reynolds

[57] ABSTRACT

A sealable body of flexible material having a body 10 with frangible seams 20 in the body joined at an apex 22. A closure seam 24 transversely intersects the apex 22. The closure seam may be ruptured at the apex and the body torn along the frangible seams to separate it from its contents.

17 Claims, 7 Drawing Figures

APPARATUS FOR COLLECTING, STORING AND DISPENSING FROZEN BLOOD PLASMA

RELATED APPLICATION

This is a continuation application to U.S. patent application Ser. No. 305,490 filed Sept. 25, 1981, now abandoned.

TECHNICAL FIELD

This invention relates generally to the field of blood component therapy and more particularly relates to apparatus for collecting, storing and dispensing blood plasma for processing into blood components such as albumin, globulins and the like.

BACKGROUND OF THE INVENTION

A relatively modern medical technology known as blood component therapy involves administering to a patient just that part of the blood that he actually needs. Rather than whole blood, the physician decides what portion or component of blood is necessary for the patient and administers only that component to him. He, thus, avoids many of the hazards which are inherent in whole blood usage. Not only is the practice better for the patient in that certain risks involving transfusing whole blood are reduced, but it permits one unit of donated blood to be used for more than one patient. For example, from one unit of whole blood, which subsequently is fractionated, there may be derived red blood cells, platelets, fresh plasma, frozen or stored plasma, albumin, globulins and the like.

Furthermore, in the most modern techniques, cell separators permit the separation of blood into its components while the donor is in the process of making a donation. Through modern technology it is possible for a blood bank to take from the donor specific components which are needed by a patient while other components are returned simultaneously to the donor.

In the technique known as plasmapheresis, the plasma is separated from the cellular elements of the blood and the cells returned to the donor. The plasma is then subsequently used for blood volume expansion or blood augmentation in the form of stored plasma or fresh frozen plasma. The plasma can also be processed into any number of useful products such as albumin, globulins and antihemophiliac factor. It is to this purpose that the present invention is directed.

Blood is collected from the donor in a connected, sealed collection system and then centrifuged to separate the cells and the plasma. The cells are returned to the donor and the plasma is subsequently frozen in the collection bag. In the frozen state the plasma may be stored for a number of months before being removed for plasma component manufacturing. Subsequently, large quantities of plasma are batch processed, i.e., plasma from many donors.

During this batch processing contamination is an obvious risk. The whole blood is initially collected in a sealed system which is followed by centrifuging and freezing while still sealed. However, the bags must ultimately be cut open and the plasma removed either manually or automatically. It is possible that during the cutting and removing operation the plasma can become contaminated.

DISCLOSURE OF THE INVENTION

Present practice involves receiving blood from the donor in a collection system and centrifuging it so that the plasma is collected in one of the bags of the system. The plasma containing bag is then separated from the rest of the collection system, frozen and stored, all prior to processing weeks or months later. Subsequently, many bags are opened, and the plasma put in a container for batch processing. The present invention is directed to an "easy-open" plasma bag which need not be cut to remove the plasma.

The "easy-open" bag which holds the plasma is a sealable container of flexible material. It comprises a body having frangible seams joined in an apex. A closure seam seals the body and intersects the apex transversely of the frangible seams. The bag is so constructed as to direct manually applied force to the apex whereby the closure seam may be ruptured at the apex and the body torn along the frangible seams and separated from the frozen plasma without any necessity for the bag being cut by a knife or any other instrument. In more specific aspects, the bag is provided with means which may be gripped for applying a rupturing force manually without the need of the bag being cut or otherwise punctured. In another more specific aspect of the invention, the bag is formed of material which is capable of remaining flexible at temperatures of −25° to −80° C. Within the scope of the invention, the bag may be made in numerous ways, such as heat sealing or blow molding, etc.

BRIEF DESCRIPTION OF THE DRAWINGS

The present invention comprises the above and other features which will now be more particularly described with reference to the accompanying drawings and pointed out in the claims. It will be understood that the particular "easy-open" flexible container embodying the invention is shown by way of illustration only and not as a limitation of the invention. The principles and features of this invention may be employed in various and numerous embodiments without departing from the scope of the invention.

BRIEF DESCRIPTION OF THE INVENTION

Figure 1:
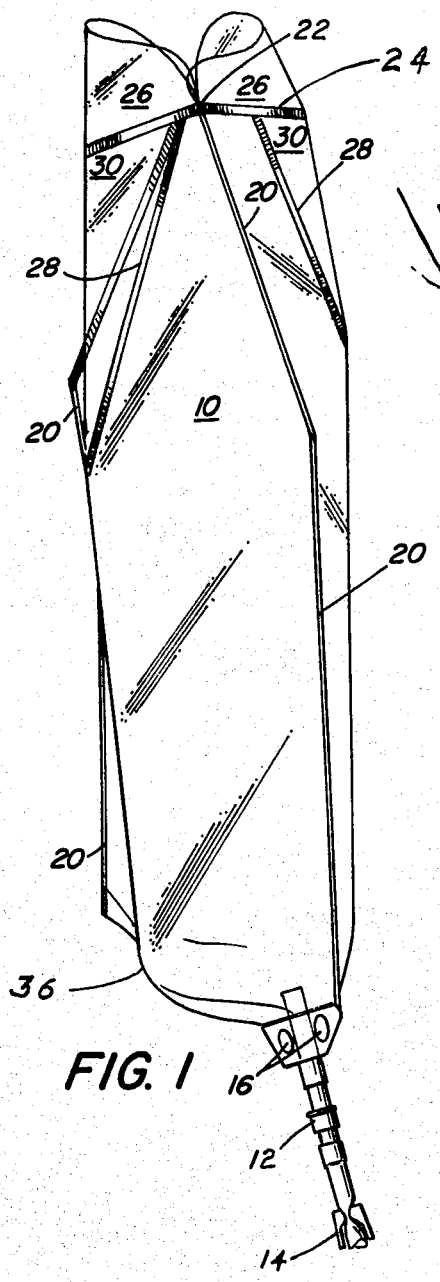
FIG. 1 is a perspective view on reduced scale of an "easy-open" sealable container or bag of flexible material embodying the invention.

FIG. 1 shows a transfer bag embodying the present invention. The bag was part of multiple bag collection system and is now in inverted position containing frozen plasma ready for opening. The body 10 of the bag communicated with a donor bag (not shown) by means of a flexible tube 12, the tube now being closed by a conventional seal 14. The bag includes hanger holes 16 which may be employed when the donor bag is being filled. The bag comprises a sealable container of flexible plastic material such as polyolefin of 6 mils thickness which is capable of remaining flexible at temperatures from −25° to −80° C., i.e., the range of temperatures in which plasma is frozen and stored.

The body 10 of the container includes a pair of frangible seams 20 running from the top to the bottom of the body (as oriented in FIG. 1). The seams are joined at an apex 22.

Figure 2:
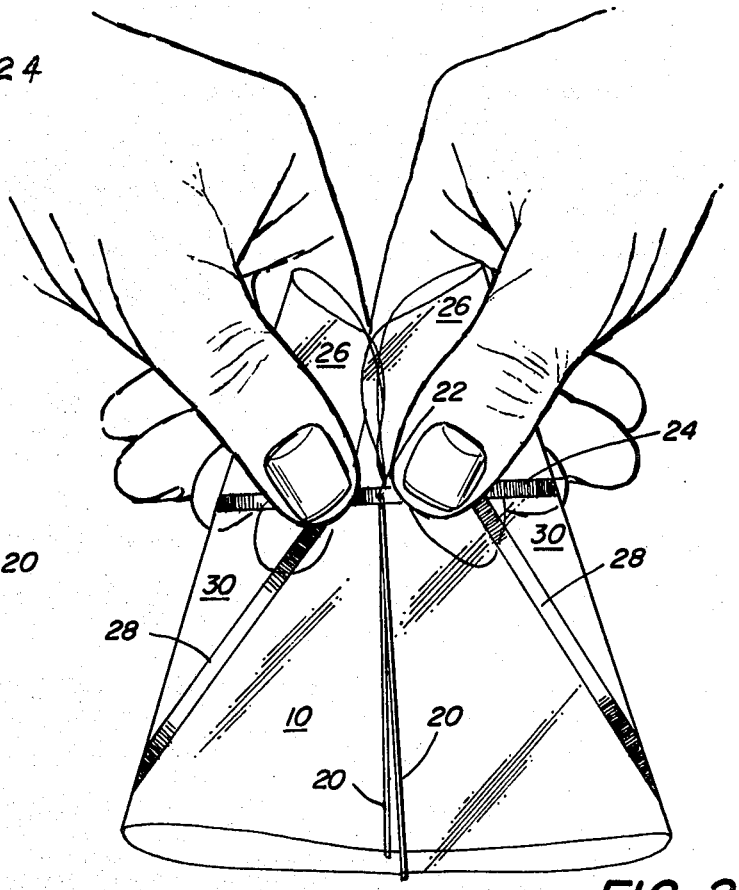
FIGS. 2 and 3 are views of the bag shown in FIG. 1 being opened.
Figure 3:
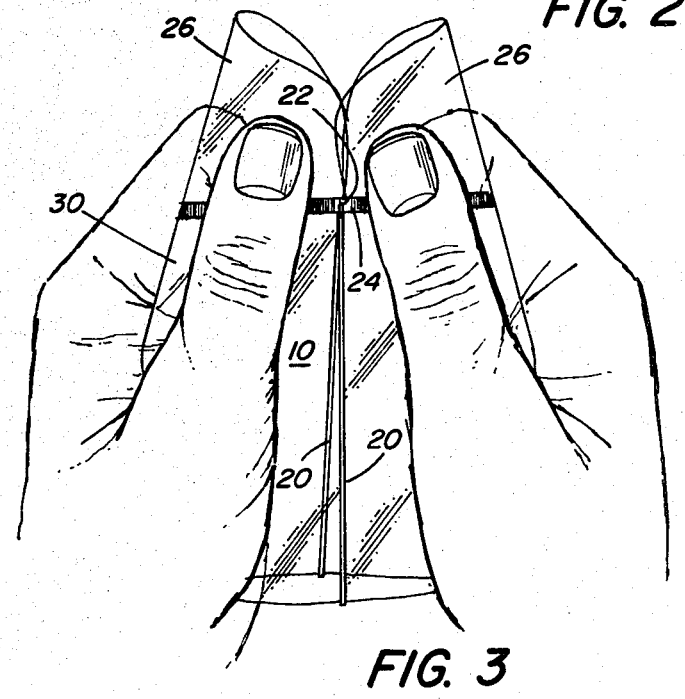

As viewed in FIGS. 2 and 3 (which is a view only slightly perspective of the openable end of the bag), the seams 20 will be seen to be located at opposite sides of the body 10 and in a plane bisecting the body. Transversely intersecting the apex 22 of the frangible seams 20 is a closure seam 24 which is of greater width than the width of the frangible seams. The apex is located within the closure seam intermediate its transverse width as shown in FIGS. 2 and 3. In the construction shown in FIGS. 1, 2 and 3 a pair of ears 26 lie laterally of the apex 22 on the side (in this instance on the top) of the closure seam 24 opposite the frangible seams 20. The edges of the ears 26 are rounded and converge toward the apex 22. The closure seam 24 is essentially a straight line sealing the top of the bag and separating the interior of the body from the ears 26.

Also as seen in FIGS. 1 and 2 (and hidden in FIG. 3) ribs 28 are formed in the body and extend from the closure seam 24 in diverging directions away from the apex 22 to the edges of the body 10. The ribs 28 define portions 30 of the body lying laterally of the apex which are sealed from the interior of the body and accordingly contain no plasma.

To open the body, the ears 26 alone or together with the closure seam 24 and/or the portions 30 are gripped and pulled apart either as shown in FIG. 2 or in FIG. 3 to direct force to the apex 22. The bag ruptures at the apex 22 permitting the body 10 to be torn apart along the frangible seams 20 whereby the flexible polyolefin may be peeled away from the frozen plasma within the bag and the plasma allowed to fall into a collection container without either being touched by a knife or other opening instrument or by human hands. The bag by then would have been inverted from the positions shown in FIGS. 1, 2 and 3. While FIGS. 2 and 3 show the flexible container being torn apart by bare hands, some may prefer to wear gloves as insulation from the cold contents.

In some prior constructions opening the bag required cutting the bag open with a knife to expose the plasma and thawing the bag slightly from the outside inwardly to release the frozen plasma from the inner surface of the bag. Because of the construction of the present invention, the bag need not be cut. Since the bag is essentially peeled back away from the frozen plasma, there is no skin thawing necessary preparatory to opening the bag.

Figure 4:
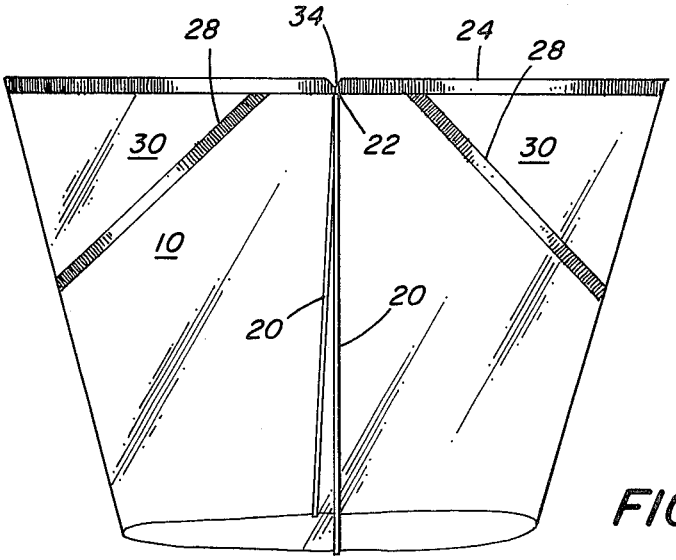
FIGS. 4 and 5 are views of alternative constructions of the bag shown in FIG. 1.

FIG. 4 shows an alternative construction of the openable portion of the bag. The closure seam 24, as in the FIG. 1 construction, is essentially a straight line running across top of the bag intersecting the apex 22 of the frangible seams 20. The closure seam 24 has a notch 34 aligned with the apex 22 to concentrate rupturing force at the apex 22. There are no ears 26 on the body and it would be optional to provide ribs 28 defining the sealed portions 30 containing no plasma.

Figure 5:
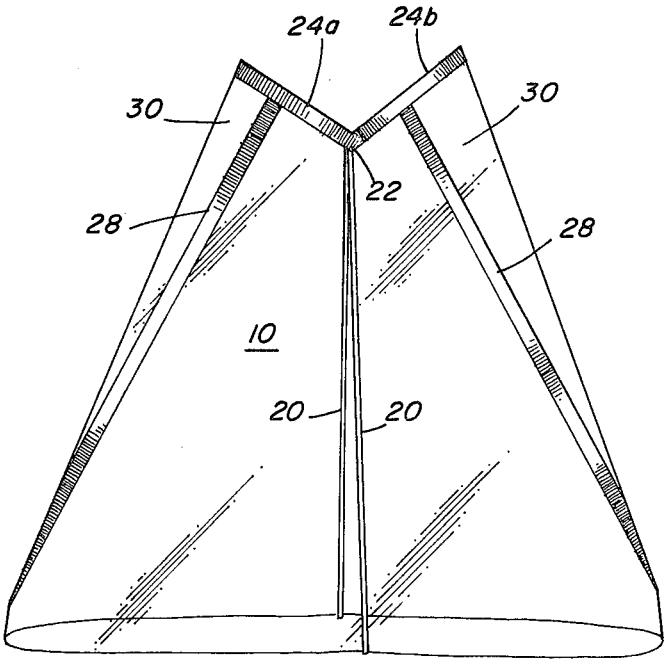

Another alternative construction of the body is shown in FIG. 5. In this alternative the closure seam 24 is of V-shape configuration comprising portions **24*a* and 24*b* converging toward the apex 22. Ribs 28 define areas 30 equivalent to the portions of like number in the FIG. 1 configuration. Again, the ribs 28 and unfilled areas 30 are optional. However, since there are no ears, it would be the unfilled portions 30 and the closure seam portions 24*a* and 24*b* that would be gripped, pulled apart to concentrate the rupturing force at the apex 22 to initiate tearing of the frangible seams 20**.

Figure 6:
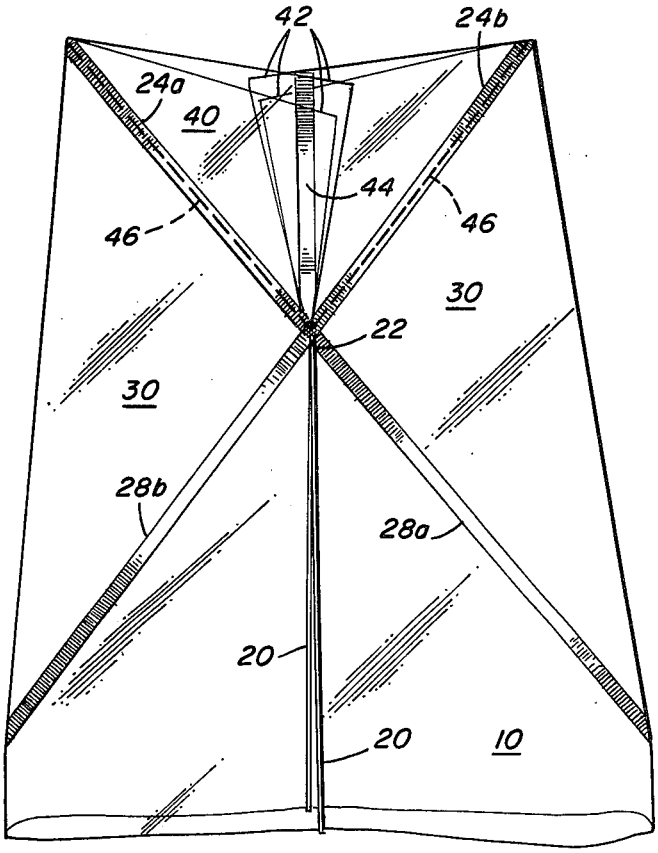
FIGS. 6 and 7 are views of another alternative construction of the bag shown in FIG. 1.
Figure 7:
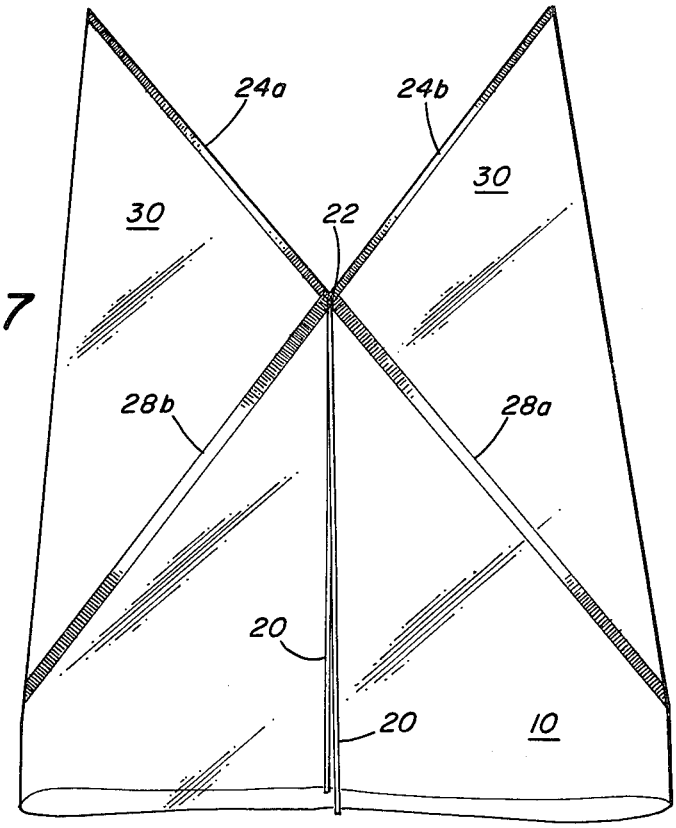

FIGS. 6 and 7 show another alternative construction. The closure seam 24 as in the FIG. 5 construction is of V-shape configuration converging at the apex 22 of the frangible seams 20. The ribs **28*a* and 28*b* also converge at the apex 22 and as in prior constructions define unfilled areas 30**.

For ease of construction, the ribs **28*a* and 28*b* converge at the apex 22. The closure seam portions 24*a* and the rib 28*a* are aligned linear extensions of each other as are the seam portion 24*b* and the rib 28*b*. By this configuration, there is a substantially triangular portion 40 on the side of the closure seam 24*a*–24*b* opposite the areas 30 which is made up of the folded overlapping corners of the bag material designated 42. These are secured together by a combining seam 44**.

The triangular portion 40 remains attached to the bag until it is ready to be opened. It will be noted in FIG. 6 that a line of serrations 46 extend along the closure seam portions **24*a* and 24*b*. The provision of the triangular portion 40 lends additional strength to the bag to guarantee against premature rupture at the apex 22**.

When the bag is ready to be opened, the portion 40 is torn from the bag along the lines of serration 46 rendering the bag as it appears in FIG. 7. Thereafter, the portions 30 and/or the closure seam portions **24*a* and 24*b* may be gripped and pulled apart to concentrate rupturing force at the apex 22** as in prior described constructions.

The various constructions may be fabricated in a number of ways. They may be made by cutting off blanks of polyolefin material from a continuous tube and forming the frangible seams 20, the bottom 36, the closure seam 24, and the ribs 28 by heat sealing. Another method of fabrication would be to start with sheet material folded upon itself with the various ribs and seams also formed by heat sealing.

Another method would be by forming the entire bag by blow molding. The various ribs and seams would be formed in the mold cavity and imparted to the bag in the blow molding process.

I claim:

1. An "easy-open" container of flexible material comprising:

a body, frangible seams extending longitudinally in the body and joined at an apex, the seams having a finite width measured transversely of their longitudinal extension, a closure seam of greater transverse width than the width of the frangible seams, said closure seam sealing the body and intersecting the apex with the apex located within the closure seam intermediate its transverse width, the container having means to direct manually applied force to the apex within the closure seam whereby the apex may be ruptured within the closure seam and the body torn to separate the body along the frangible seams.

2. A container according to claim 1 wherein portions of the body material are located laterally of the apex and provide means to be gripped for applying rupturing force to the closure seam at the apex of the frangible seams.

3. A container according to claim 1 wherein there are ribs extending from the closure seam which diverge in directions away from the apex to define unfilled areas of the body which may be gripped to apply a rupture force to the closure seam at the apex of the frangible seams.

4. A container of claim 1 wherein the closure seam is essentially a straight line.

5. The container of claim 1 wherein the closure seam is of V-shape converging at said apex.

6. The container of claim 1 wherein the closure seam includes an external notch pointing toward said apex.

7. The container of claim 1 wherein portions of the flexible material lie laterally of the apex on the side of the closure seam opposite the frangible seams and are formed to direct rupture force to the apex when the lateral portions are pulled apart.

8. The container of claim 1 wherein the body is formed from a sheet and the seams therein are formed by heat sealing.

9. The container of claim 1 wherein the body is formed by blow molding.

10. The container of claim 1 wherein the plastic material is capable of remaining flexible at temperatures of −25° C. to −80° C.

11. The container of claim 1 wherein the flexible material is a polyolefin.

12. The container of claim 1 having removable material on the side of the closure seam which is opposite the frangible seams to render this closure seam less likely to be ruptured prematurely.

13. A sealable container of flexible material comprising:

a body, frangible seams in the body joined at an apex within the perimeter of the body, a closure seam of V-shape configuration sealing the body and intersecting the apex, said closure seam defining a V-shape removable portion of body material pointing toward the apex whereby when the V-shape body material is removed the closure seam may be ruptured at the apex and the body torn along the frangible seams to separate it from its contents.

14. The container of claim 13 wherein a serration separates the removable portion from the remainder of the body.

15. The container of claim 13 wherein ribs extend from the closure seam and diverge in directions away from the apex to define unfilled areas of the body which may be gripped to apply a rupture force to the closure seam at the apex of the frangible seams.

16. The container of claim 15 wherein the ribs converge at the apex of the frangible seams.

17. The container of claim 15 wherein the ribs are aligned linear extensions of the V-shape closure seam.

* * * * *